US008368619B2

(12) United States Patent
Tsai et al.

(10) Patent No.: US 8,368,619 B2
(45) Date of Patent: Feb. 5, 2013

(54) PIXEL CIRCUIT, ACTIVE MATRIX ORGANIC LIGHT EMITTING DIODE DISPLAY AND DRIVING METHOD FOR PIXEL CIRCUIT

(75) Inventors: Tsung-Ting Tsai, Hsin-Chu (TW); Yuan-Chun Wu, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 476 days.

(21) Appl. No.: 12/609,969

(22) Filed: Oct. 30, 2009

(65) Prior Publication Data

US 2011/0050659 A1 Mar. 3, 2011

(30) Foreign Application Priority Data

Aug. 26, 2009 (TW) ..... 98128731 A

(51) Int. Cl.
*G09G 3/30* (2006.01)

(52) U.S. Cl. ..... 345/76; 345/82

(58) Field of Classification Search ..... 345/76, 345/82

See application file for complete search history.

(56) References Cited

U.S. PATENT DOCUMENTS 7,327,357 B2 2/2008 Jeong
2006/0066532 A1* 3/2006 Jeong ..... 345/76
2006/0267885 A1* 11/2006 Kwak et al. ..... 345/76
2007/0200802 A1* 8/2007 Kasai ..... 345/76
2007/0268220 A1* 11/2007 Lee et al. ..... 345/76

* cited by examiner

*Primary Examiner* — Chanh Nguyen
*Assistant Examiner* — Roy Rabindranath
(74) *Attorney, Agent, or Firm* — WPAT PC; Justin King

(57) ABSTRACT

An exemplary pixel circuit includes an organic light emitting diode (OLED), a storage capacitance, a driving transistor and first through fourth switching transistors. The driving transistor is for generating a pixel current according to a charge amount stored on the storage capacitance to drive the OLED at a predetermined luminance. The on/off states of the first through fourth transistors are controlled by the same control signal. By means of particular electrical connection relationships of the first through fourth transistors in the pixel circuit, the pixel current flowing through the OLED is irrelevant to the power supply voltage and the threshold voltage of the driving transistor but is increased along with the increase of a cross-voltage of the OLED resulting from long-term use. The present invention also provides an active matrix OLED display using the above-mentioned pixel circuit and a driving method for the pixel circuit.

3 Claims, 3 Drawing Sheets

PIXEL CIRCUIT, ACTIVE MATRIX ORGANIC LIGHT EMITTING DIODE DISPLAY AND DRIVING METHOD FOR PIXEL CIRCUIT

CROSS-REFERENCE TO RELATED APPLICATIONS

This application is based upon and claims the benefit of priority from the prior Taiwanese Patent Application No. 098128731, filed Aug. 26, 2009, the entire contents of which are incorporated herein by reference.

BACKGROUND

1. Technical Field

The present invention generally relates to organic light emitting diode (OLED) display technology fields and, particularly to a pixel circuit, an active matrix OLED display and a driving method for pixel circuit.

2. Description of the Related Art

In a pixel circuit of an organic light emitting diode display, charges are stored in a storage capacitor for controlling the luminance of an OLED via a transistor. Referring to FIG. 1, a schematic diagram of a conventional pixel circuit is shown. The pixel circuit 200 includes a P-type driving transistor 202, an N-type switching transistor 204, a storage capacitor Cst and an OLED 210. The source S of the driving transistor 202 is electrically coupled to a power supply voltage OVDD. The gate G of the switching transistor 204 is electrically coupled to receive a scanning signal SCAN, the drain D of the switching transistor 204 is electrically coupled to receive a data voltage (i.e., generally pixel voltage) Vdata, and the source S of the switching transistor 204 is electrically coupled to the gate G of the driving transistor 202. The storage capacitor Cst is electrically coupled between the gate G and the source S of the driving transistor 202, and a capacitor cross-voltage thereof is labeled by Vsg. The positive terminal of the OLED 210 is electrically coupled to the drain D of the driving transistor 202, and the negative terminal of the OLED 210 is electrically coupled to another power supply voltage OVSS. A pixel current flowing through the driving transistor 202 in the pixel circuit is controlled by the capacitor cross-voltage Vsg, that is, the pixel current Ioled is equal to $K*(Vsg-V_{TH})^2$; wherein K is a constant, the level of Vsg is relevant with the levels of the power supply voltage OVDD and data voltage Vdata, and $V_{TH}$ is a threshold voltage of the driving transistor 202.

In the active matrix OLED display 200, since the power supply voltage OVDD for each pixel circuit is electrically coupled with that for another pixel circuit, when the OLED 210 is driven to light on, a metal wire for transmitting the power supply voltage OVDD will have a current flowing therethrough, an IR-drop would be existed resulting from the inherent resistance of the metal wire, which would result in the power supply voltage OVDD for each pixel circuit different from that for another pixel circuit and thus the pixel currents Ioled for the respective pixel circuits are different from one another. Different pixel currents flowing through the respective OLEDs 210 would produce different luminance levels and thereby cause non-uniformity of display. In addition, since the influence of manufacturing process, the threshold voltage $V_{TH}$ of the driving transistor 202 in each pixel circuit would be different from that in another pixel circuit, so that even if the same data voltages Vdata are supplied, the pixel currents still are different from one another and thus the non-uniformity of display occurs. Moreover, the OLED 210 has an increasing cross-voltage, along with the increase of using time, due to material attenuation, the pixel current Ioled is decreased correspondingly and the overall luminance of display is reduced as a result.

BRIEF SUMMARY

The present invention is directed to a pixel circuit, so as to effectively overcome the drawbacks associated with non-uniformity of display and material attenuation of OLED.

The present invention is further directed to an active matrix OLED display, so as to effectively overcome the drawbacks associated with non-uniformity of display and material attenuation of OLED.

The present invention is still further directed to a driving method for pixel circuit, so as to effectively overcome the drawbacks associated with non-uniformity of display and material attenuation of OLED.

In order to achieve the above-mentioned objective, or to achieve other objectives, a pixel circuit in accordance with an embodiment of the present invention is provided. The pixel circuit includes an OLED, a storage capacitor, a driving transistor, a first switching transistor, a second switching transistor, a third switching transistor and a fourth switching transistor. The storage capacitor includes a first terminal and a second terminal. The driving transistor is for driving the OLED to light on at a predetermined luminance, the first source/drain of the driving transistor is electrically coupled to the first terminal of the storage capacitor, and the second source/drain of the driving transistor is electrically coupled to the OLED. The gate of the first switching transistor is electrically coupled to receive a scanning signal, the first source/drain of the first switching transistor is electrically coupled to a predetermined voltage, and the second source/drain of the first switching transistor is electrically coupled to the first terminal of the storage capacitor. The gate of the second switching transistor is electrically coupled to receive the scanning signal, the first source/drain of the second switching transistor is electrically coupled to the second terminal of the storage capacitor, and the second source/drain of the second switching transistor is electrically coupled to the gate of the driving transistor. The gate of the third switching transistor is electrically coupled to receive the scanning signal, the first source/drain of the third switching transistor is electrically coupled to the second source/drain of the driving transistor, and the second source/drain of the third switching transistor is electrically coupled to the gate of the driving transistor. The gate of the fourth switching transistor is electrically coupled to receive the scanning signal, the first source/drain of the fourth switching transistor is electrically coupled to the second terminal of the storage capacitor, and the second source/drain of the fourth switching transistor is electrically coupled to receive a data voltage.

In one embodiment, on/off states of the first and second switching transistors are opposite to on/off states of the third and fourth switching transistors. Moreover, the first and second switching transistors can be P-type transistors, e.g., P-type thin film transistors; and the third and fourth switching transistors can be N-type transistors, e.g., N-type thin film transistors.

In order to achieve the above-mentioned objective, or to achieve other objectives, an active matrix OLED display in accordance with another embodiment of the present invention is provided. The active matrix OLED display includes a data driving circuit, a scan driving circuit and at least a pixel circuit. The pixel circuit includes an OLED, a storage capacitor, a driving transistor, a first switching transistor, a second switching transistor, a third switching transistor and a fourth switching transistor. The storage capacitor includes a first terminal and a second terminal. The driving transistor is for driving the OLED to light on at a predetermined luminance. The first source/drain of the driving transistor is electrically coupled to the first terminal of the storage capacitor, and the second source/drain of the driving transistor is electrically coupled to the OLED. The gate of the first switching transistor is electrically coupled to the scan driving circuit through a scan line, the first source/drain of the first switching transistor is electrically coupled to a predetermined voltage, and the second source/drain of the first switching transistor is electrically coupled to the first terminal of the storage capacitor. The gate of the second switching transistor is electrically coupled to the scan driving circuit through the scan line, the first source/drain of the second switching transistor is electrically coupled to the second terminal of the storage capacitor, and the second source/drain of the second switching transistor is electrically coupled to the gate of the driving transistor. The gate of the third switching transistor is electrically coupled to the scan driving circuit through the scan line, the first source/drain of the third switching transistor is electrically coupled to the second source/drain of the driving transistor, and the second source/drain of the third switching transistor is electrically coupled to the gate of the driving transistor. The gate of the fourth switching transistor is electrically coupled to the scan driving circuit through the scan line, the first source/drain of the fourth switching transistor is electrically coupled to the second terminal of the storage capacitor, and the second source/drain of the fourth switching transistor is electrically coupled to the data driving circuit through a data line. Moreover, gate-on voltages of the first and second switching transistors are phase-inverted with respect to gate-on voltages of the third and fourth switching transistors. Furthermore, the first and second switching transistors can be P-type transistors, e.g., P-type thin film transistors; and the third and fourth switching transistors can be N-type transistors, e.g., N-type thin film transistors.

In order to achieve the above-mentioned objective, or to achieve other objectives, a driving method for a pixel circuit in accordance with still another embodiment of the present invention is provided. The pixel circuit includes an OLED, a storage capacitor and a driving transistor. The driving transistor is for driving the OLED to light on at a predetermined luminance. The first source/drain of the driving transistor is electrically coupled to a first terminal of the storage capacitor, and the second source/drain of the driving transistor is electrically coupled to the OLED. The driving method includes the following steps: providing a predetermined voltage to the first terminal of the storage capacitor and enabling a second terminal of the storage capacitor to communicate with the gate of the driving transistor; providing a data voltage to the second terminal of the storage capacitor, allowing the first terminal of the storage capacitor to discharge via the driving transistor and the OLED until a conductive current of the OLED is substantially zero and thereby an amount of charges are stored in the storage capacitor; and providing the predetermined voltage again to the first terminal of the storage capacitor, enabling the second terminal of the storage capacitor to communicate with the gate of the driving transistor and thereby the driving transistor produces a pixel current for driving the OLED to light on at the predetermined luminance according to the amount of charges stored in the storage capacitor.

In one embodiment, when the pixel circuit further includes a first switching transistor and a second switching transistor, the first source/drain of the first switching transistor being electrically coupled to the predetermined voltage, the second source/drain of the first switching transistor being electrically coupled to the first terminal of the storage capacitor, the first source/drain of the second switching transistor being electrically coupled to the second terminal of the storage capacitor and the second source/drain of the second switching transistor being electrically coupled to the gate of the driving transistor, the step of providing the predetermined voltage to the first terminal of the storage capacitor and enabling the second terminal of the storage capacitor to communicate with the gate of the driving transistor includes: switching on the first and second switching transistors.

In one embodiment, when the pixel circuit further includes a third switching transistor and a fourth switching transistor, the first source/drain of the third switching transistor being electrically coupled to the second source/drain of the driving transistor, the second source/drain of the third switching transistor being electrically coupled to the gate of the driving transistor, the first source/drain of the fourth switching transistor being electrically coupled to the second terminal of the storage capacitor and the second source/drain of the fourth switching transistor being electrically coupled to receive the data voltage, the step of providing the data voltage to the second terminal of the storage capacitor, allowing the first terminal of the storage capacitor to discharge via the driving transistor and the OLED until the conductive current of the OLED is substantially zero and thereby the amount of charges are stored in the storage capacitor includes: switching off the first and second switching transistors, and switching on the third and fourth switching transistors. Furthermore, the step of providing the predetermined voltage to the first terminal of the storage capacitor and enabling the second terminal of the storage capacitor to communicate with the gate of the driving transistor can further include: switching off the third and fourth switching transistors.

In one embodiment, on/off states of the first, second, third and fourth switching transistors are determined by the same control signal.

In one embodiment, the step of providing the predetermined voltage again to the first terminal of the storage capacitor, enabling the second terminal of the storage capacitor to communicate with the gate of the driving transistor and thereby the driving transistor produces the pixel current for driving the OLED to light on at the predetermined luminance according to the amount of charges stored in the storage capacitor includes: switching on the first and second switching transistors, and switching off the third and fourth switching transistors.

In the above-mentioned embodiments of the present invention, by way of particular circuit design for the pixel circuit, the level of pixel current flowing through the OLED is related to the data voltage and the cross-voltage of the OLED and irrelevant to the predetermined voltage and the threshold voltage of the driving transistor. Therefore, the pixel circuit, the active matrix OLED display and the driving method for pixel circuit in accordance with the embodiments of the present invention can effectively overcome the drawbacks associated with non-uniformity of display and material attenuation of OLED, the display quality is improved and the objectives of the present invention are achieved as a result.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
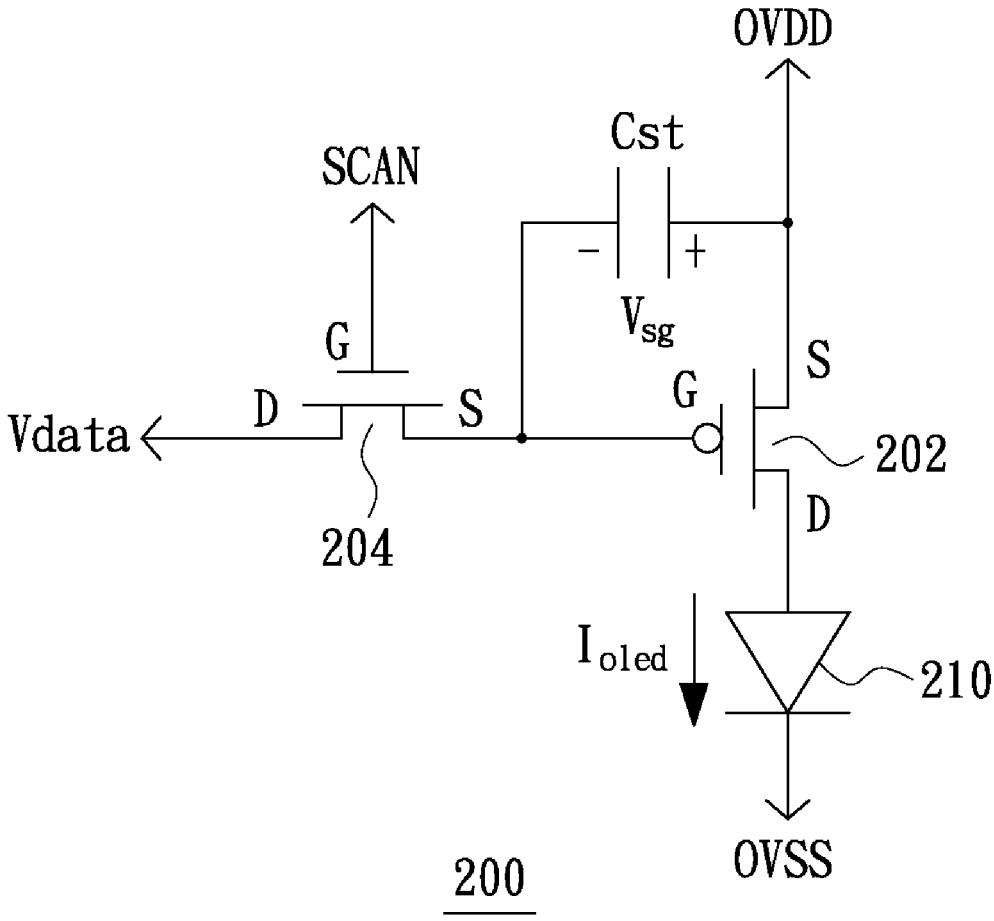
FIG. 1 (Prior Art)
FIG. 1 is a schematic diagram of a conventional pixel circuit.
Figure 2:
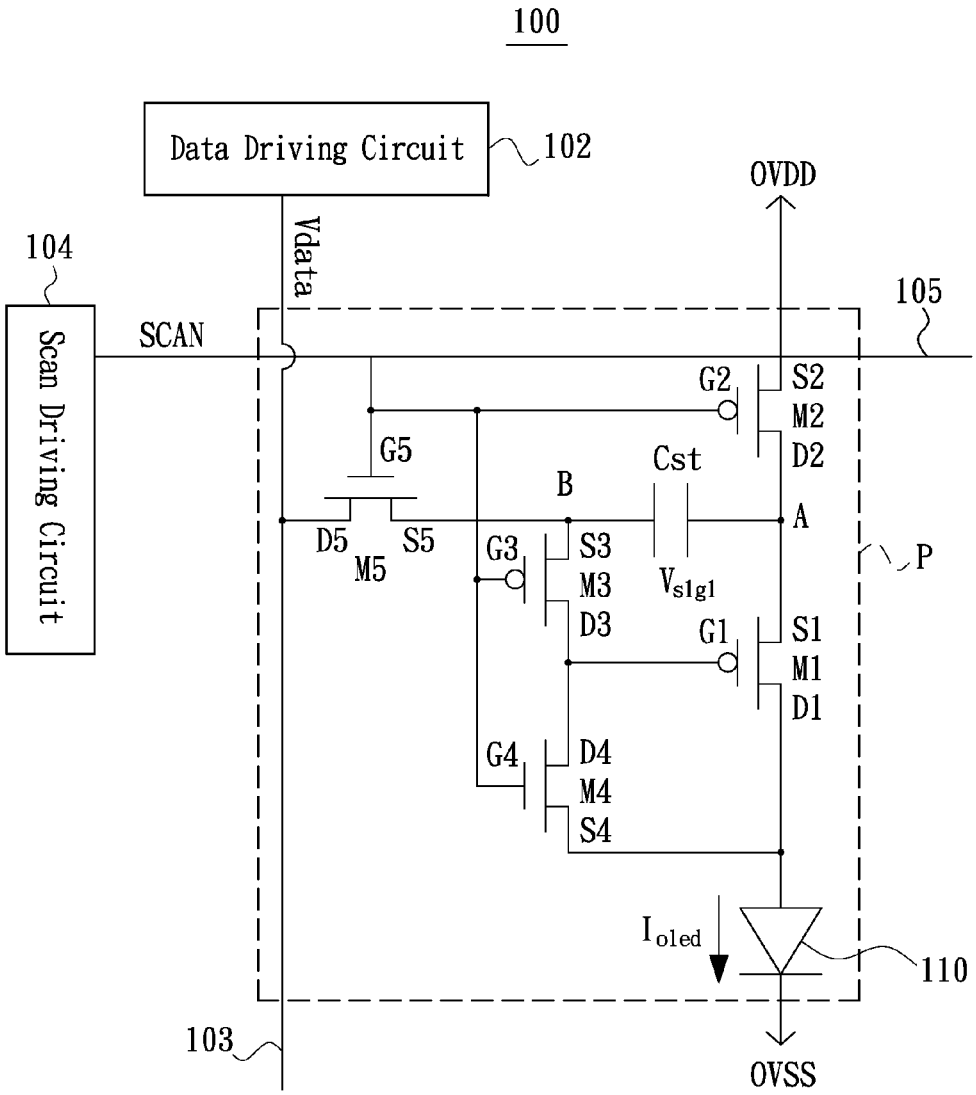
FIG. 2 shows an active matrix OLED display in accordance with an embodiment of the present invention.

Referring to FIG. 2, showing an active matrix OLED display in accordance with an embodiment of the present invention. The active matrix OLED display 100 includes a data driving circuit 102, a scan driving circuit 104 and a plurality of pixel circuits P. FIG. 2 only illustrates one pixel circuit P as an example, but not to limit the present invention. As illustrated in FIG. 2, the data driving circuit 102 is for providing a data voltage Vdata, and the scan driving circuit 104 is for providing a scanning signal SCAN. The pixel circuit P includes a storage capacitor Cst, a driving transistor M1, switching transistors M2~M5 and an OLED 110. The driving transistor M1 is for driving the OLED 110 to light on at a predetermined luminance. The source 51 of the driving transistor M1 is electrically coupled to the terminal A of the storage capacitor Cst, the drain D1 of the driving transistor M1 is electrically coupled to the positive terminal of the OLED 110. The negative terminal of the OLED 110 is electrically coupled to a power supply voltage OVSS. The gate G2 of the switching transistor M2 is electrically coupled to a scan line 105 (FIG. 2 only illustrates one scan line as an example, but not to limit the present invention) to receive the scanning signal SCAN from the scan driving circuit 104 through the scan line 105, the source S2 of the switching transistor M2 is electrically coupled to another power supply voltage OVDD, and the drain D2 of the switching transistor M2 is electrically coupled to the terminal A of the storage capacitor Cst. The gate G3 of the switching transistor M3 is electrically coupled to the scan line 105 to receive the scanning signal SCAN from the scan driving circuit 104 through the scan line 105, the source S3 of the switching transistor M3 is electrically coupled to a terminal B of the storage capacitor Cst, and the drain D3 of the switching transistor M3 is electrically coupled to the gate G1 of the driving transistor M1. The gate G4 of the switching transistor M4 is electrically coupled to the scan line 105 to receive the scanning signal SCAN from the scan driving circuit 104 through the scan line 105, the source S4 of the switching transistor M4 is electrically coupled to the drain D1 of the driving transistor M1, and the drain D4 of the switching transistor M4 is electrically coupled to the gate G1 of the driving transistor M1. The gate G5 of the switching transistor M5 is electrically coupled to the scan line 105 to receive the scanning signal SCAN from the scan driving circuit 104 through the scan line 105, the source S5 of the switching transistor M5 is electrically coupled to the terminal B of the storage capacitor, and the drain D5 of the switching transistor M5 is electrically coupled to a data line 103 (FIG. 2 only illustrates one data line as an example, but not to limit the present invention) to receive a data voltage Vdata from the data driving circuit 102 through the data line 103. Moreover, gate-on voltages of the switching transistors M2, M3 are phase-inverted with respect to gate-on voltages of the switching transistors M4, M5, for example, the switching transistors M2, M3 are P-type transistors (e.g., P-type thin film transistors), and the switching transistors M4, M5 are N-type transistors (e.g., N-type thin film transistors). Correspondingly, on/off states of the switching transistors M2, M3 are opposite to on/off states of the switching transistors M4, M5.

Figure 3:
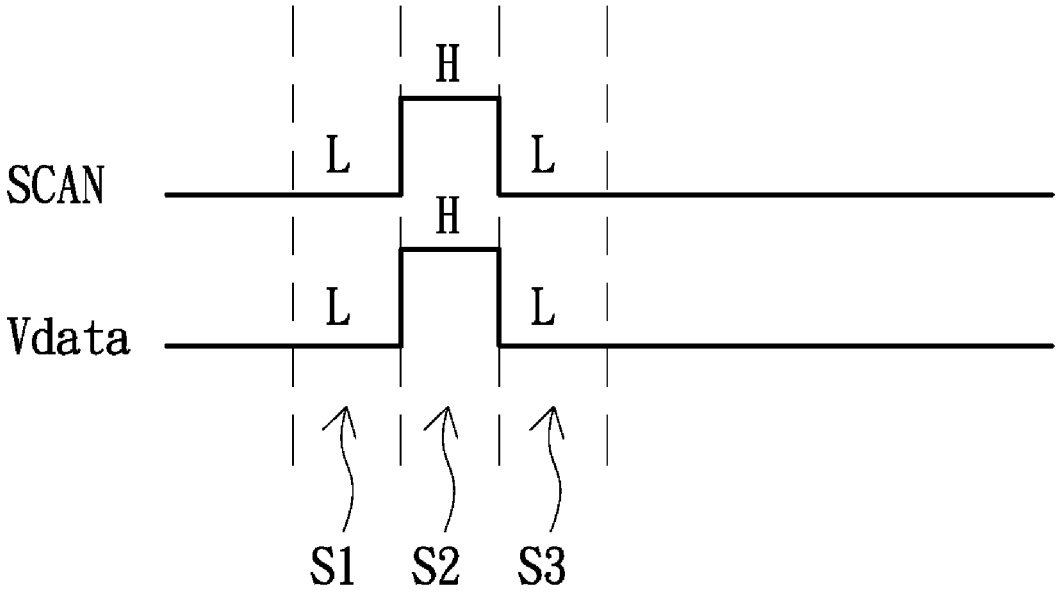
FIG. 3 shows timing diagrams associated with a driving method for pixel circuit in accordance with an embodiment of the present invention.

A driving method for pixel circuit of the active matrix OLED display 100 will be described below in detail with reference to FIGS. 2 and 3. FIG. 3 shows timing diagrams associated with the driving method for the pixel circuit P in accordance with an embodiment of the present invention. As seen from FIG. 3, a process for driving the pixel circuit P includes a first stage S1, a second stage S2 and a third stage S3.

More specifically, during the first stage S1 of the driving method for the pixel circuit P, the scanning signal SCAN provided by the scan driving circuit 104 is a low-voltage level "L", so that the switching transistors M2, M3 are switched-on and the switching transistors M4, M5 are switched-off. The power supply voltage OVDD is provided to the terminal A of the storage capacitor Cst through the switched-on switching transistor M2 and thus the voltage level at the terminal A of the storage capacitor is OVDD. The terminal B of the storage capacitor Cst is electrically communicated with the gate G1 of the driving transistor M1 via the switched-on the switching transistor M3.

During the subsequent second stage S2, the voltage level of the scanning signal SCAN provided from the scan driving circuit 104 is changed to be a high-voltage level "H" and thus the switching transistors M2, M3 are switched-off. At this time, the switching transistors M4, M5 are switched-on correspondingly. The terminal A of the storage capacitor Cst discharges with respect to the power supply voltage OVSS via the source-drain S1-D1 of the driving transistor M1 and the OLED 110 until a conductive current of the OLED 110 is substantially zero. The positive terminal of the OLED 110 has a voltage level Voled (i.e., the sum of the cross-voltage of the OLED 110 and the power supply voltage OVSS) thereat, and thus the voltage level at the terminal A of the storage capacitor Cst is (Voled+$V_{TH}$); wherein $V_{TH}$ is the threshold voltage of the driving transistor M1. The voltage Voled is varied along with the material attenuation characteristic of the OLED 110, i.e., the longer the using time of the OLED 110, the higher the voltage level Voled. Turning back to FIG. 2, the data voltage Vdata from the data driving circuit 102 is provided to the terminal B of the storage capacitor Cst through the switched-on switching transistor M5 and thus the voltage level at the terminal B of the storage capacitor Cst is Vdata. As a result, an amount of charges stored in the storage capacitor Cst are (Voled+$V_{TH}$−Vdata).

Then, during the third stage S3, the scanning signal SCAN from the scan driving circuit 104 is changed to be the low-voltage level "L" and thus the switching transistors M2, M3 are switched-on. At this time, the switching transistors M4, M5 are switched-off correspondingly. The driving transistor M1 generates a pixel current Ioled for driving the OLED 110 to light on at a predetermined luminance according to the amount of charges (i.e., the capacitor cross-voltage $V_{s1g1}$) stored in the storage capacitor Cst. The terminal B of the storage capacitor Cst is electrically communicated with the gate G1 of the driving transistor M1 due to the switched-on switching transistor M3. The power supply voltage OVDD is provided again to the terminal A of the storage capacitor Cst through the switched-on switching transistor M2, so that the voltage level at the terminal A of the storage capacitor Cst is changed from (Voled+$V_{TH}$) to OVDD. The voltage level at the terminal B of the storage capacitor Cst is increased by ΔV due to continuousness of voltages of a capacitor at two terminals. The voltage ΔV is equal to the variation of the voltage level at the terminal A of the storage capacitor Cst from (Voled+$V_{TH}$) to OVDD, i.e., ΔV=OVDD−Voled−$V_{TH}$○ Consequently, the voltage level at the terminal B of the storage capacitor Cst is changed to be (Vdata+ΔV), i.e., (Vdata+OVDD−Voled−$V_{TH}$).

Moreover, the pixel current Ioled flowing through the OLED 110 satisfies the condition that Ioled=K*($V_{s1g1}$−$V_{TH}$)$^2$, the voltage Vs1 at the source S1 of the driving transistor M1, i.e., the voltage level at the terminal A of the storage capacitor Cst is OVDD. Therefore, the pixel current Ioled=K*[(OVDD−Vdata−OVDD+Voled+$V_{TH}$)−$V_{TH}$]$^2$=K*(Voled−Vdata)$^2$. It is found that, during the third stage S3 (i.e., emission stage), the level of the pixel current Ioled flowing through the OLED 110 is only related to the voltage level Voled and the data voltage Vdata and irrelevant with the threshold voltage $V_{TH}$ of the driving transistor M1 and the power supply voltage OVDD. Accordingly, when the voltage level Voled at the positive terminal of the OLED 110 is increased along with long using time of the OLED 110, the pixel current Ioled is increased to compensate the reduced luminance of the OLED 110. Thus, the non-uniformity of display caused by the material attenuation issue of the OLED, the influence of IR-drop, and the influence of the threshold voltage of the driving transistor M1 resulting form the manufacturing process can be effectively improved, and therefore the active matrix OLED display 100 can achieve better display quality under long time use.

In summary, in the above-mentioned embodiments of the present invention, by way of particular circuit design for the pixel circuit, the value of pixel current flowing through the OLED is related to the data voltage and the cross-voltage of the OLED and irrelevant with the predetermined voltage and the threshold voltage of the driving transistor. Therefore, the pixel circuit, the active matrix OLED display and the driving method for pixel circuit in accordance with the embodiments of the present invention can effectively overcome the drawbacks associated with non-uniformity of display and material attenuation of OLED, the display quality is improved and the objectives of the present invention are achieved as a result.

Additionally, the skilled person in the art can make some modifications with respect to the active matrix OLED display and the driving method for pixel circuit in accordance with the above-mentioned embodiments, for example, changing the circuit configuration of the pixel circuit, the amount of the pixel circuits in the active matrix OLED display, the types (i.e., P-type or N-type) of the transistors, interchanging the electrical connections of the sources and the drains of the respective transistors, and so on, as long as such modification(s) would not depart from the scope and spirit of the present invention.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A driving method for a pixel circuit, wherein the pixel circuit comprises an organic light emitting diode, a storage capacitor and a driving transistor, the driving transistor is for driving the organic light emitting diode to light on at a predetermined luminance, the first source/drain of the driving transistor is electrically coupled to a first terminal of the storage capacitor, and the second source/drain of the driving transistor is electrically coupled to a power supply voltage through the organic light emitting diode, the driving method comprising the following steps:

providing a predetermined voltage larger than the power supply voltage to the first terminal of the storage capacitor and enabling a second terminal of the storage capacitor to communicate with the gate of the driving transistor;

providing a data voltage to the second terminal of the storage capacitor, allowing the first terminal of the storage capacitor to discharge via the driving transistor and the organic light emitting diode until a conductive current of the OLED is substantially zero and thereby an amount of charges stored in the storage capacitor can be Voled+$V_{TH}$−Vdata, where Voled is the sum of the cross-voltage of the OLED and the power supply voltage, $V_{TH}$ is the threshold voltage of the driving transistor, and Vdata is the data voltage; and providing the predetermined voltage again to the first terminal of the storage capacitor, enabling the second terminal of the storage capacitor to communicate with the gate of the driving transistor and thereby the driving transistor produces a pixel current to drive the organic light emitting diode to light on at the predetermined luminance according to the amount of charges stored in the storage capacitor, wherein when the pixel circuit further comprises a first switching transistor and a second switching transistor, the first source/drain of the first switching transistor is electrically coupled to the predetermined voltage, the second source/drain of the first switching transistor is electrically coupled to the first terminal of the storage capacitor, the first source/drain of the second switching transistor is electrically coupled to the second terminal of the storage capacitor, and the second source/drain of the second switching transistor is electrically coupled to the gate of the driving transistor, the step of providing the predetermined voltage to the first terminal of the storage capacitor and enabling the second terminal of the storage capacitor to communicate with the gate of the driving transistor comprises:

switching on the first and second switching transistors, wherein when the pixel circuit further comprises a third switching transistor and a fourth switching transistor, the first source/drain of the third switching transistor is electrically coupled to the second source/drain of the driving transistor, the second source/drain of the third switching transistor is electrically coupled to the gate of the driving transistor, the first source/drain of the fourth switching transistor is electrically coupled to the second terminal of the storage capacitor, and the second source/drain of the fourth switching transistor is electrically coupled to receive the data voltage, the step of providing the data voltage to the second terminal of the storage capacitor, allowing the first terminal of the storage capacitor to discharge via the driving transistor and the organic light emitting diode until the conductive current of the organic light emitting diode is substantially zero and thereby the amount of charges are stored in the storage capacitor comprises:

switching off the first and second switching transistors, and switching on the third and fourth switching transistors, wherein on/off states of the first, second, third and fourth switching transistors are determined by the same control signal.

2. The driving method as claimed in claim 1, wherein the step of providing the predetermined voltage to the first terminal of the storage capacitor and enabling the second terminal of the storage capacitor to communicate with the gate of the driving transistor further comprises:

switching off the third and fourth switching transistors.

3. The driving method as claimed in claim 1, wherein the step of providing the predetermined voltage again to the first terminal of the storage capacitor, enabling the second terminal of the storage capacitor to communicate with the gate of the driving transistor and thereby the driving transistor produces the pixel current to drive the organic light emitting diode to light on at the predetermined luminance according to the amount of charges stored in the storage capacitor comprises:

switching on the first and second switching transistors, and switching off the third and fourth switching transistors.

* * * * *